US009549449B2

(12) United States Patent
Chen

(10) Patent No.: US 9,549,449 B2
(45) Date of Patent: Jan. 17, 2017

(54) FAULT DETECTION APPARATUS AND FAULT DETECTION METHOD THEREOF

(71) Applicant: ADVANCED OPTOELECTRONIC TECHNOLOGY, INC., Hsinchu Hsien (TW)

(72) Inventor: Yuan-Ching Chen, Hsinchu (TW)

(73) Assignee: ADVANCED OPTOELECTRONIC TECHNOLOGY, INC., Hsinchu Hsien (TW)

( * ) Notice: Subject to any disclaimer, the term of this patent is extended or adjusted under 35 U.S.C. 154(b) by 0 days.

(21) Appl. No.: 14/823,397

(22) Filed: Aug. 11, 2015

(65) Prior Publication Data

US 2016/0227613 A1 Aug. 4, 2016

Related U.S. Application Data

(60) Provisional application No. 62/110,438, filed on Jan. 30, 2015.

(51) Int. Cl.
*H05B 33/08* (2006.01)

(52) U.S. Cl.
CPC ..... *H05B 33/089* (2013.01); *H05B 33/0809* (2013.01); *H05B 33/0827* (2013.01)

(58) Field of Classification Search
CPC ..... H05B 33/089; H05B 33/0827
USPC ..... 315/130
See application file for complete search history.

(56) References Cited

U.S. PATENT DOCUMENTS

| | | | | |
|---|---|---|---|---|
| 8,310,159 | B2 * | 11/2012 | Bigge | H05B 37/02 315/119 |
| 2007/0013322 | A1 * | 1/2007 | Tripathi | H05B 33/0815 315/291 |
| 2007/0013333 | A1 * | 1/2007 | Ajima | H02P 6/18 318/432 |
| 2009/0009362 | A1 * | 1/2009 | Miller | H05B 33/0803 340/907 |
| 2010/0060175 | A1 * | 3/2010 | Lethellier | H05B 33/0815 315/164 |
| 2012/0126715 | A1 * | 5/2012 | Sato | H05B 41/2882 315/224 |
| 2012/0313545 | A1 * | 12/2012 | Courtel | H05B 33/0815 315/250 |
| 2015/0373803 | A1 * | 12/2015 | Yoneoka | H05B 33/089 315/297 |
| 2016/0095194 | A1 * | 3/2016 | Yoneoka | H05B 37/032 315/121 |

FOREIGN PATENT DOCUMENTS

| | | | |
|---|---|---|---|
| JP | P2006-147252 | A | 6/2006 |
| JP | P2008-146836 | A | 6/2008 |
| TW | 200420195 | A | 10/2004 |
| TW | 201138552 | A1 | 11/2011 |

* cited by examiner

*Primary Examiner* — Dylan White
(74) *Attorney, Agent, or Firm* — Zhigang Ma

(57) ABSTRACT

A fault detection apparatus coupling with a lamp module includes a current detector and a controlling module. The controlling module is coupled with the current detector. A fault detection method of a fault detection apparatus is also provided in the present disclose. The method includes providing a current detector to detect a current variation of one lamp of a lamp module in a period, and provide a controlling module to compare the current variation with a reference value stored in the controlling module to determine a state of the lamp module.

13 Claims, 8 Drawing Sheets

FAULT DETECTION APPARATUS AND FAULT DETECTION METHOD THEREOF

CROSS-REFERENCE TO RELATED APPLICATIONS

This application claims the benefit under 35 U.S.C. §119 (c) of U.S. Provisional Application No. 62/110,438, filed on Jan. 30, 2015, entitled "FAULT DETECTION APPARATUS AND FAULT DETECTION METHOD THEREOF", the disclosure of which is incorporated by reference herein.

FIELD

The subject matter herein generally relates to a fault detection apparatus for a lamp module having a plurality of lamps coupled in parallel.

BACKGROUND

A typical lamp module may include a plurality of lamps in parallel connection, it causes difficult to distinguish an open-circuit state or an short-circuit state of the lamp module in a timely manner.

BRIEF DESCRIPTION OF THE DRAWINGS

Implementations of the present technology will now be described, by way of examples only, with reference to the attached figures.

DETAILED DESCRIPTION OF EMBODIMENTS

Figure 1:
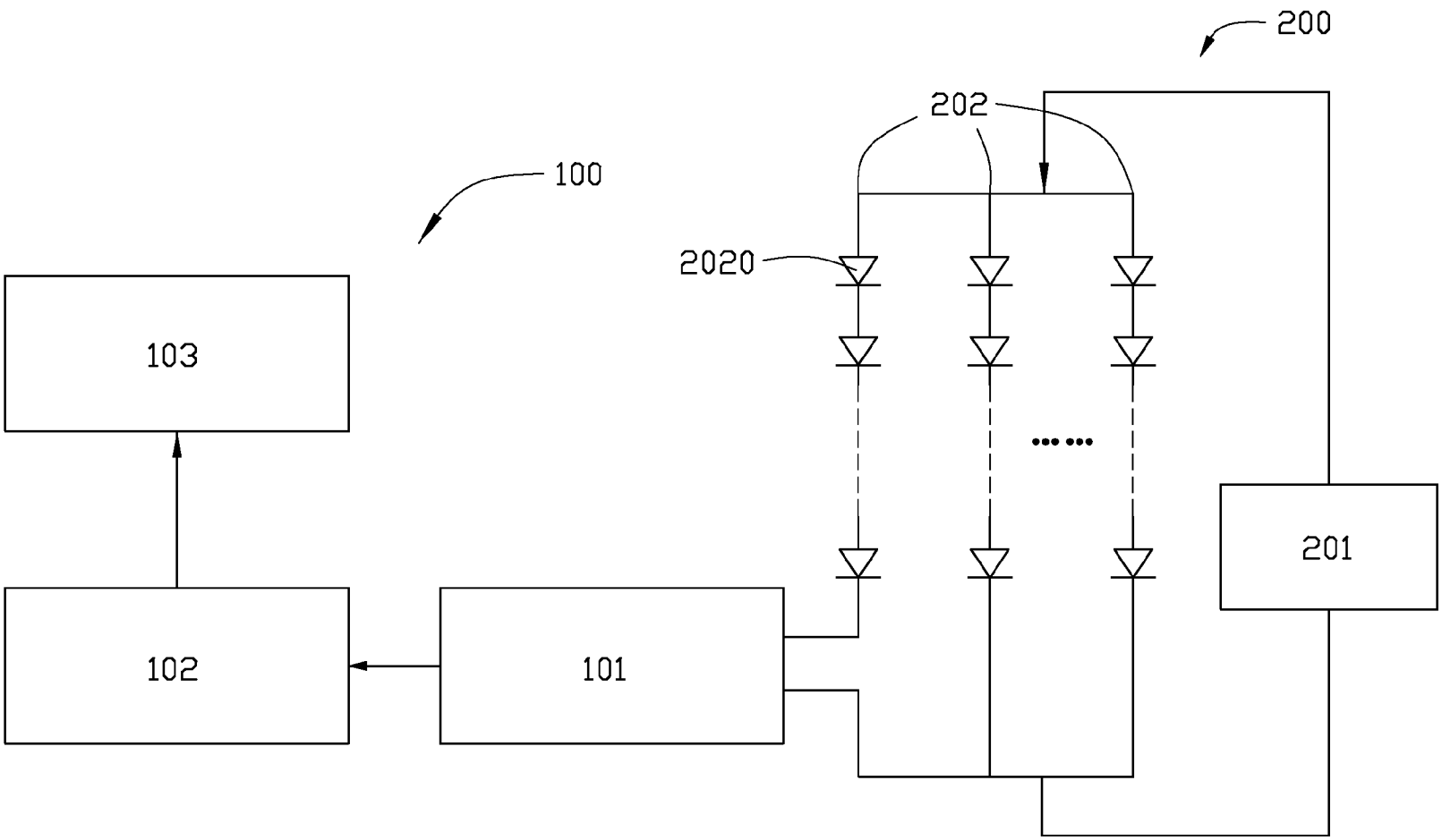
FIG. 1 is a diagrammatic view of a fault detection apparatus coupled with a lamp module in accordance with an embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising," when utilized, means "including, but not necessarily limited to"; it specifically indicates open-ended inclusion or membership in the so-described combination, group, series and the like.

FIG. 1 illustrates a lamp fault detection apparatus 100 coupling with a lamp module 200. The lamp module 200 includes a driver 201 and a plurality of lamps 202 in parallel connection. The lamp fault detection apparatus 100 is configured to determine the lamp module 200 in a normal state, in an open-circuit state or in a short-circuit state, based on the current variation of one lamp 202 of the lamp module 200.

The lamp fault detection apparatus 100 includes a current detector 101 and a controlling module 102 coupled with the current detector 101. Further, the lamp fault detection apparatus 100 can include an indicating module 103 coupled with the controlling module 102, which is configured for telling users the states of the lamp module 200.

The current detector 101 is coupled with a lamp 202 of the lamp module 200, and detects the current variation of the lamp 202. The current detector 101 can be a Hall current transformer. The controlling module 102 gets the current variation of the lamp 202 to calculate the state of the lamp module 200. Further, the controlling module 102 can control the indicating module 103 to tell users the calculated state of the lamp module 200. The controlling module 102 can be a micro-controller unit having a central processing unit (CPU) in combination with an appropriate software.

The indicating module 103 can include a display for displaying the state of the lamp module 200 based on the calculated state. Further, when the lamp module 200 is in a fault state, the indicating module 103 can display the location of the faulty lamp 202 resulting in the fault state of the lamp module 200. The fault state can be the open-circuit state or the short-circuit state. The indicating module 103 can also include an alarm device to warn users when a fault of the lamp module 200 is detected. Alternatively, the indicating module 103 can be a communication module. The communication module can transmit a signal of the lamp state to a remote monitor to do some actions.

The driver 201 of the lamp module 200 supplies power to the plurality of lamps 202 respectively. In this embodiment, the driver 201 provides a constant current to the lamps 202 respectively. The driver 201 can be a constant current source.

Each of the lamps 202 has a plurality of light sources 2020. The light sources 2020 can be light emitting diodes. The number of the lamps 202 of this lamp module 200 can be M, where $M \geq 2$. And each lamp 202 has N light sources 2020 in series connection, $N \geq 2$, although each of the M modules does not need have the same number of lamps. In one example, the lamp module 200 has nine lamps 202, and each lamp 202 has nine light sources 2020. And a constant output current from the driver 201 is 4.5 A, thus, current flowing through each lamp 202 is 0.5 A when the lamp module 200 work in a normal state.

Figure 2:
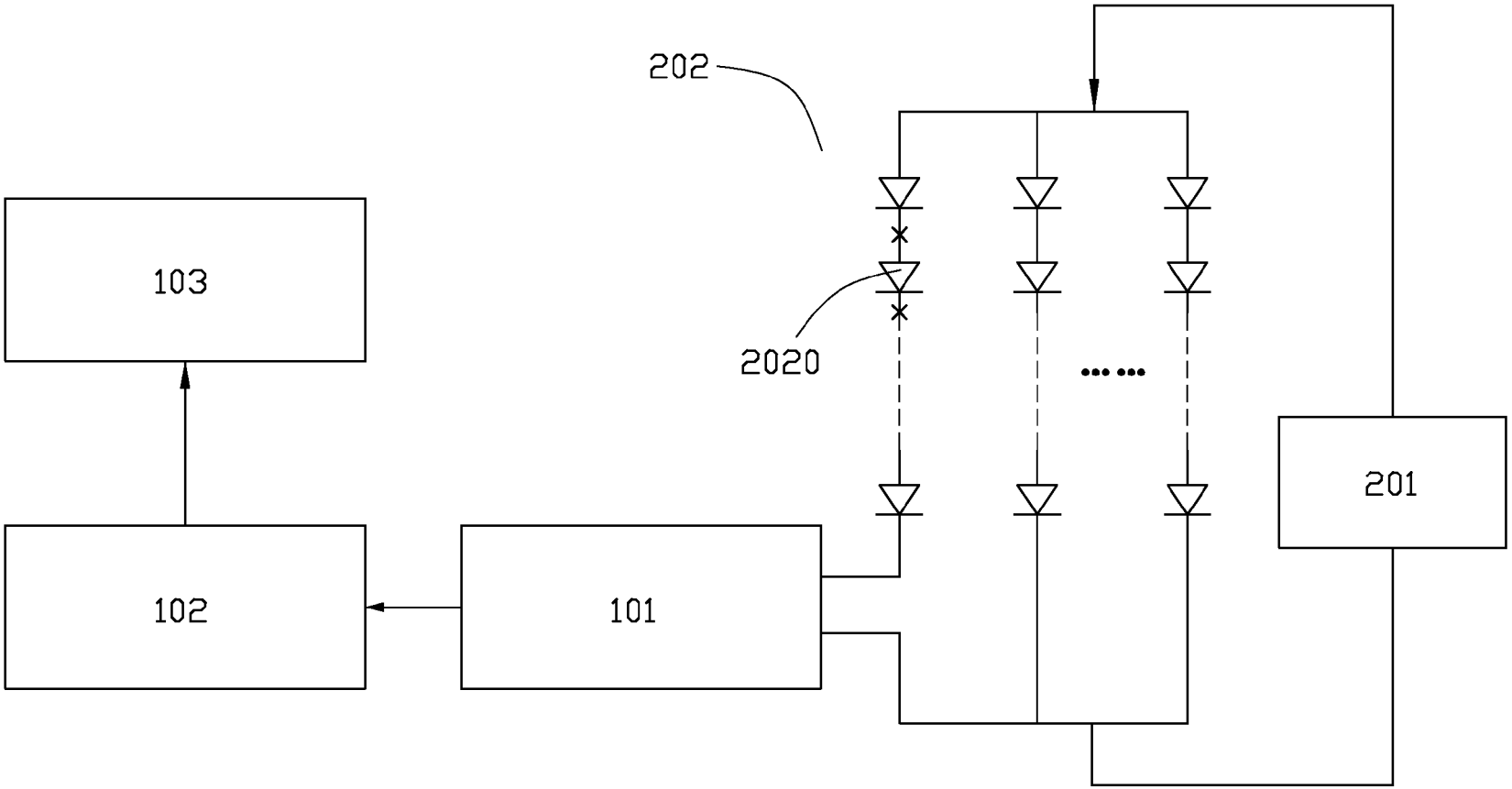
FIG. 2 is a diagrammatic view of a fault detection apparatus coupled with a lamp module wherein a lamp of the lamp module is in an open-circuit state in accordance with a first embodiment of the present disclosure.
Figure 3:
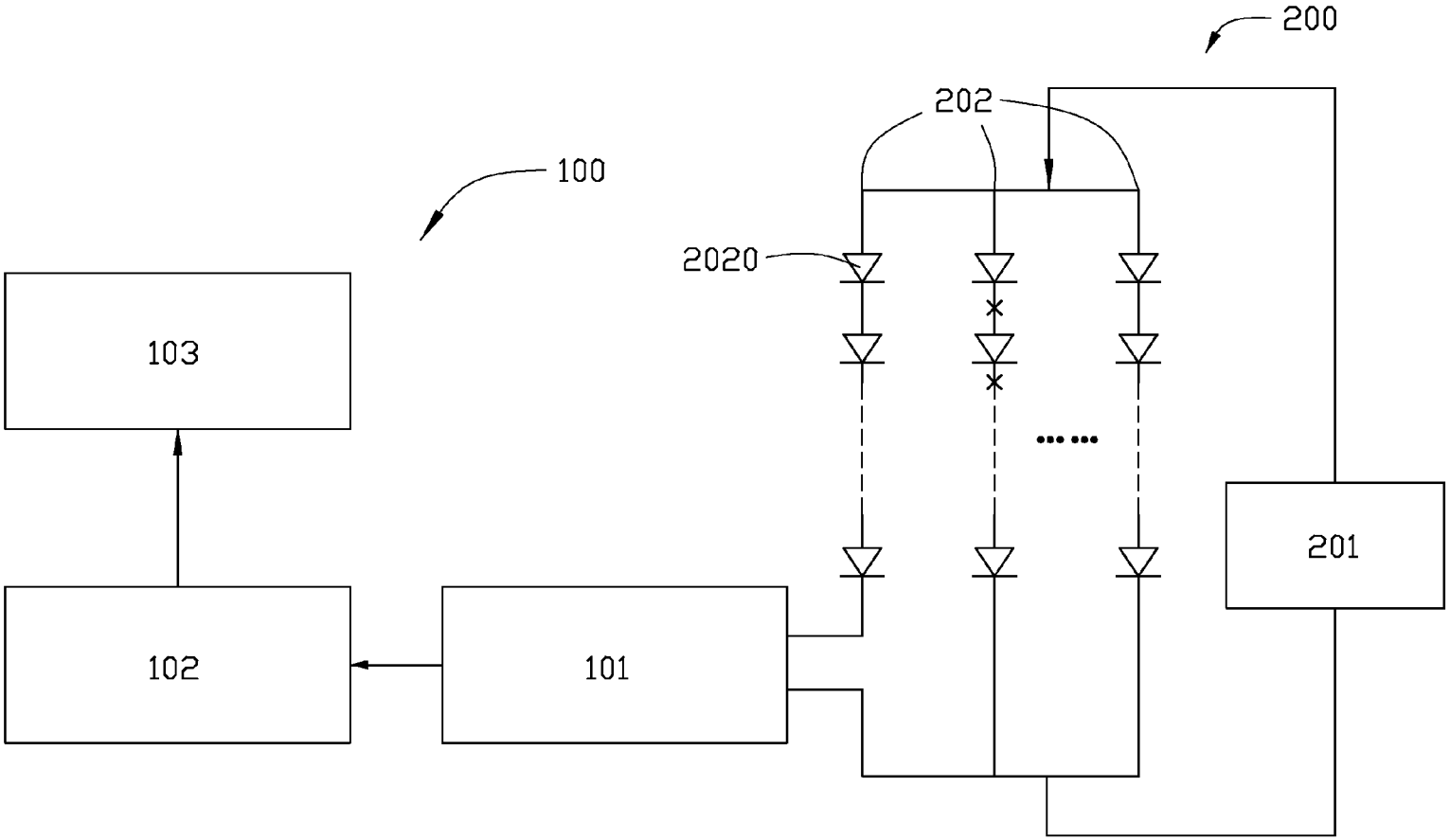
FIG. 3 is a diagrammatic view of a fault detection apparatus coupled with a lamp module wherein a lamp of the lamp module is in an open-circuit state in accordance with a second embodiment of the present disclosure.
Figure 4:
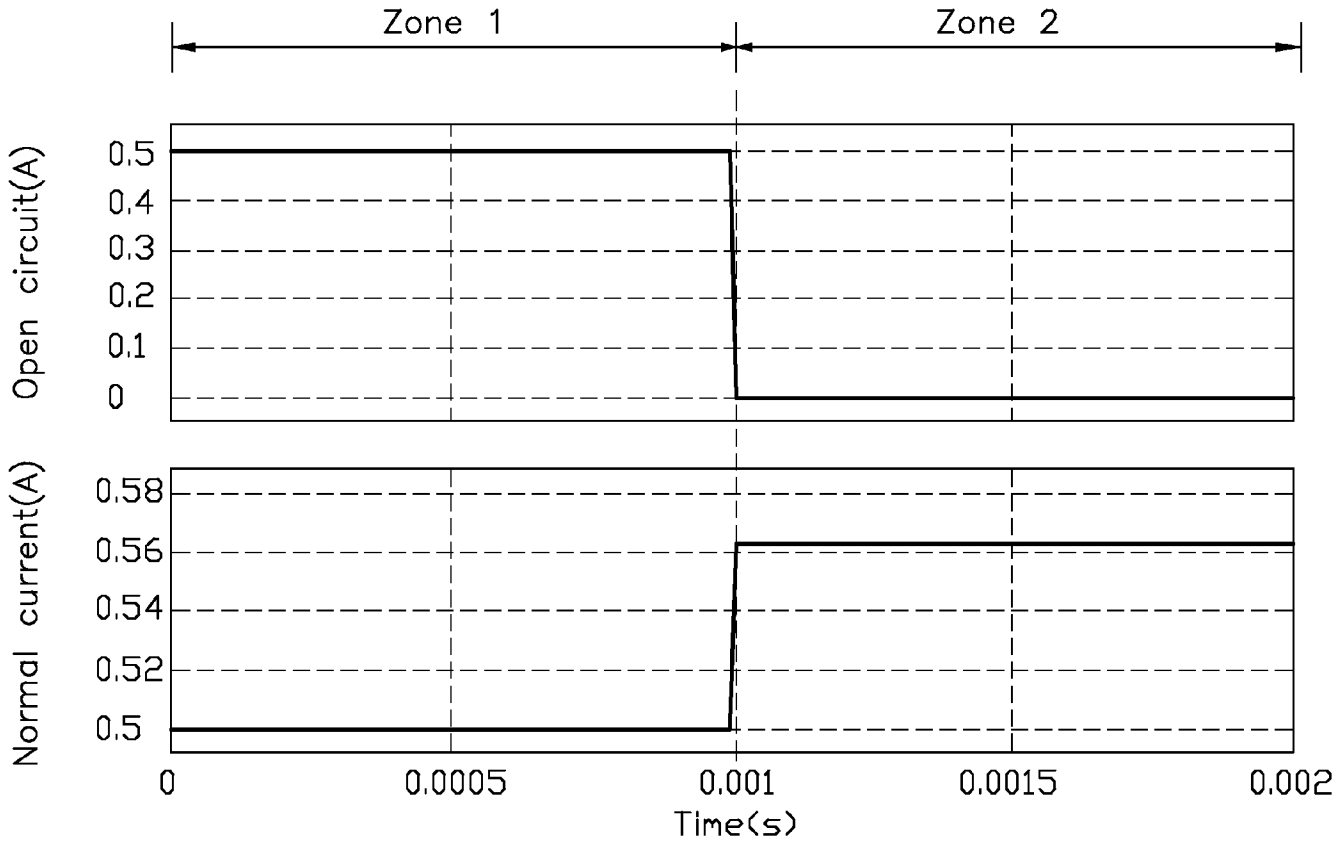
FIG. 4 shows a current variation of the lamps of the lamp module of FIG. 2 or FIG. 3.

As shown in FIG. 2 and FIG. 4, when the lamp module 200 is in a normal state, current flowing through each lamp 202 is 0.5 A, which is shown in zone 1 of FIG. 4. When a lamp 202 of the lamp module 200 is in an open-circuit state, the current flowing through the lamp 202, which is in the fault state, drops from 0.5 A to 0 A, and current flowing through other eight lamps 202, which were previously in normal state, increases from 0.5 A to about 0.56 A (shown in FIG. 4). The current flowing through the lamp 202, which is in the open-circuit state, drops by about 100%, and the current flowing through other eight lamps 202 which were previous in a normal state increases by about 12%. In one example embodiment, the current detector 101 is coupled with the lamp 202 which is in an open-circuit state. Alternatively, the current detector 101 can be coupled with the other lamp 202, which is in normal state, as shown in FIG. 3.

Figure 5:
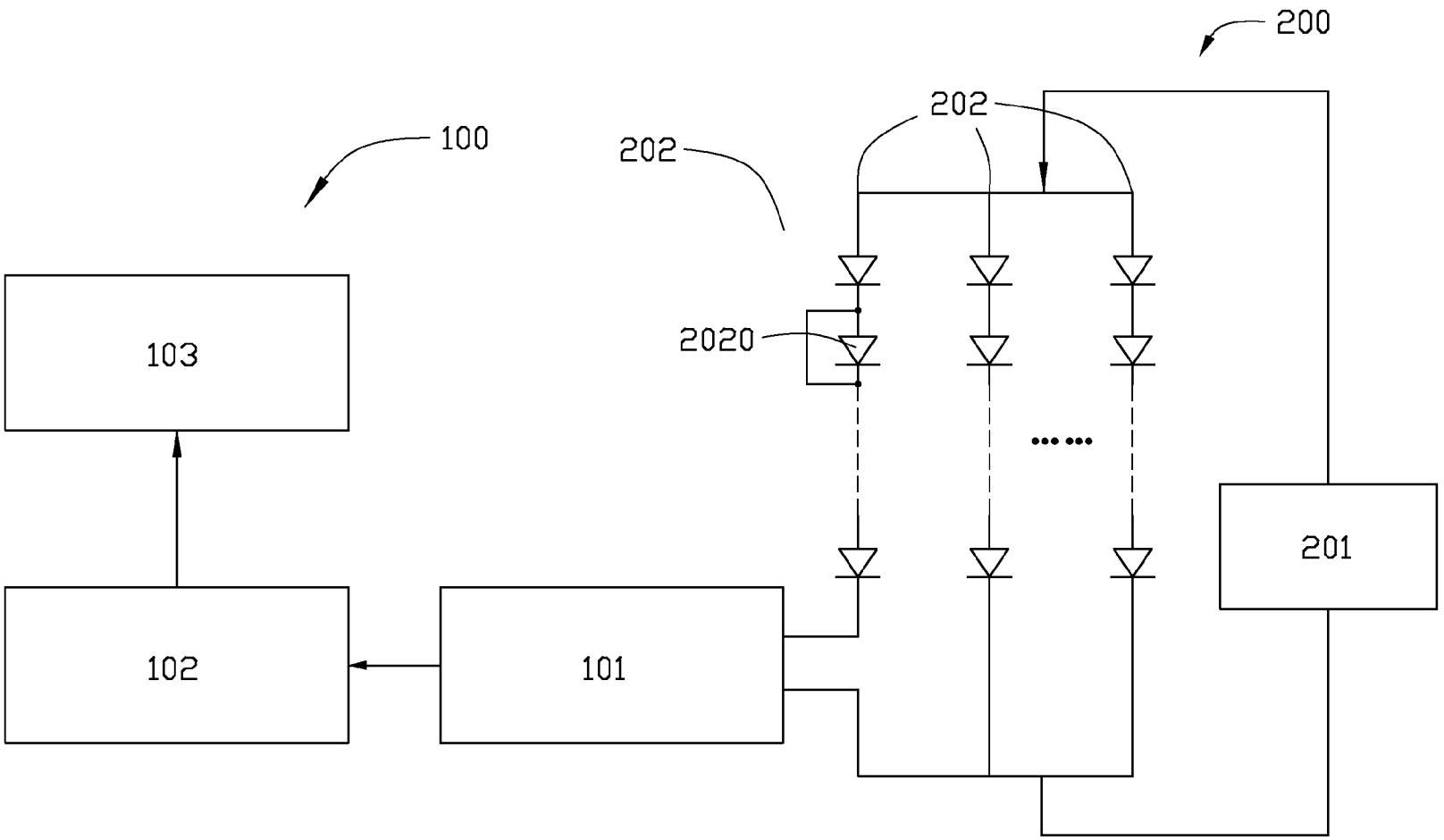
FIG. 5 is a diagrammatic view of a fault detection apparatus coupled with a lamp module wherein a lamp of the lamp module is in a short-circuit state in accordance with a first embodiment of the present disclosure.
Figure 6:
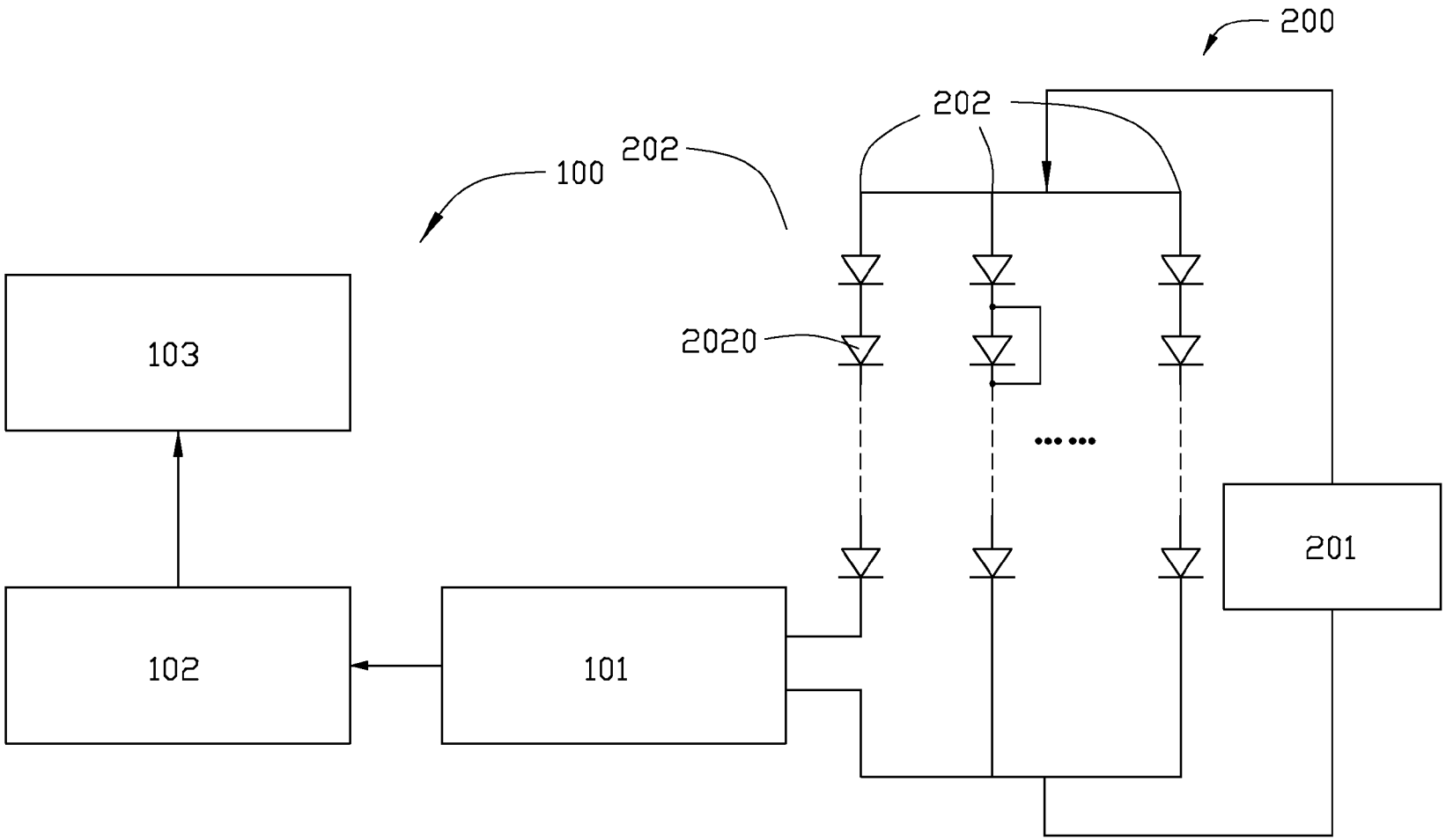
FIG. 6 is a diagrammatic view of a fault detection apparatus coupled with a lamp module wherein a lamp of the lamp module is in a short-circuit state in accordance with a second embodiment of the present disclosure.
Figure 7:
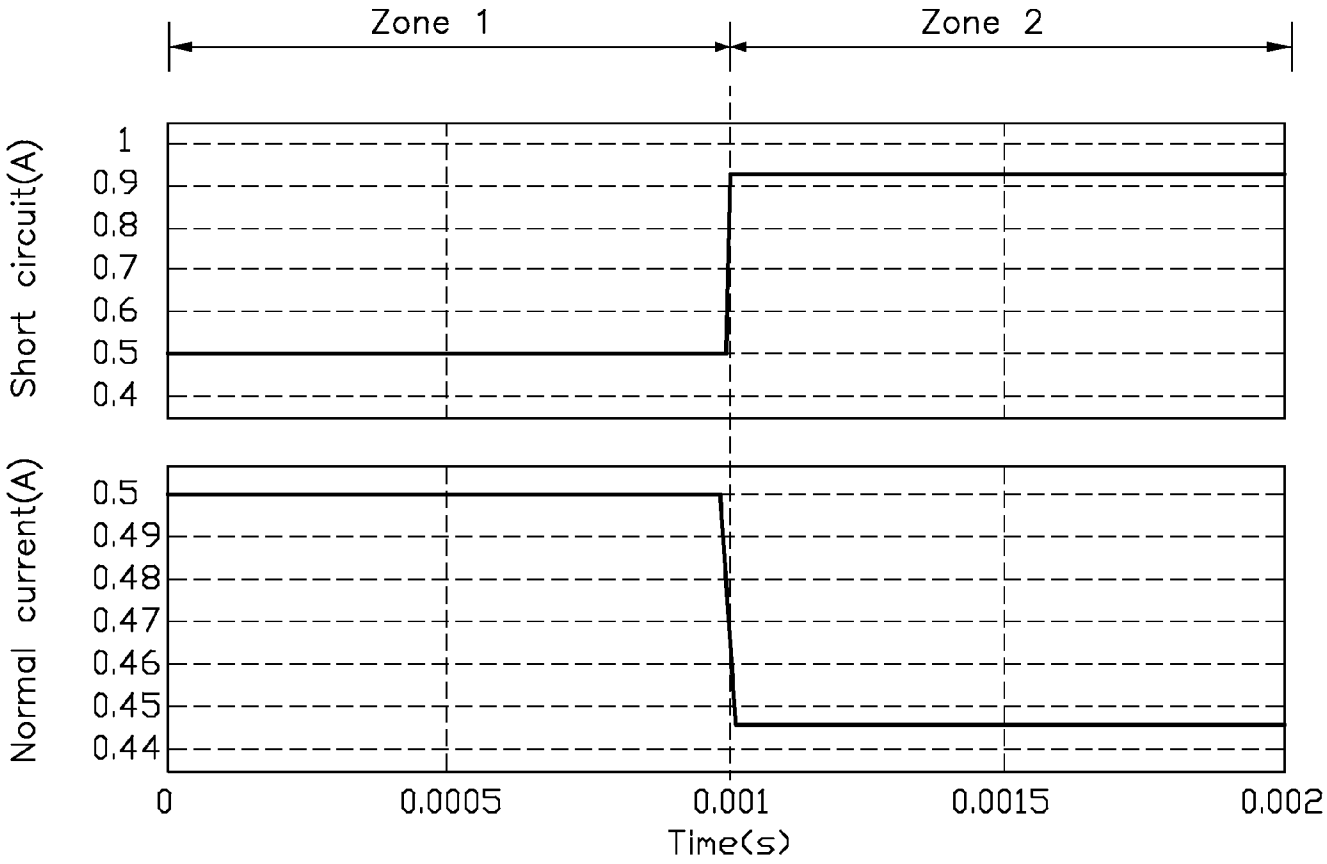
FIG. 7 shows a current variation of the lamps of the lamp module of FIG. 5 or FIG. 6.

As shown in FIG. 5 and FIG. 7, when one light source 2020 of a lamp 202 is in a short-circuit state, the current flowing through the lamp 202, which is in short-circuit state, increases from 0.5 A to about 0.93 A, and current flowing through other lamps 202, which were previously in a normal state, decreases from 0.5 A to about 0.445 A. In other words, the current flowing through the lamp 202, which is in short-circuit state, increases about by 86%, and current flowing through other lamps 202, which were previous in normal state, decreases by about 11%. In one example embodiment, the current detector 101 is coupled with the lamps 202 which is in a short-circuit state. Alternatively, the current detector 101 can be coupled with the other lamp 202, which is in normal state, as shown in FIG. 6.

In this exemplary embodiment, a first reference value C1 can be defined to help determine the states of the lamp module 200. When the current detector 101 detects the current decreasing by near 11%, the lamp module 200 is in a short-circuit state. When the current detector 101 detects the current decreasing by more than 11% and near 100%, then, the lamp module 200 is in an open-circuit state.

Accordingly, in this exemplary embodiment, a second reference value C2 can be defined. When the current detector 101 detects the current increasing by near 12%, the lamp module 200 is in an open-circuit state. When the current detector 101 detects the current increasing is more than 12% and is near 86%, then, the lamp module 200 is in a short-circuit state.

Further, a safe reference value S can be further defined to allow for a normal current variation when the lamp module is in a normal state. For example, when a current disturbance occurs, a current variation will happens and the lamp module 200 is still in a normal state. When the current variation of a lamp 202 of the lamp module 200 is below the safe reference value S, the lamp module 200 is considered to be in a normal state.

Figure 8:
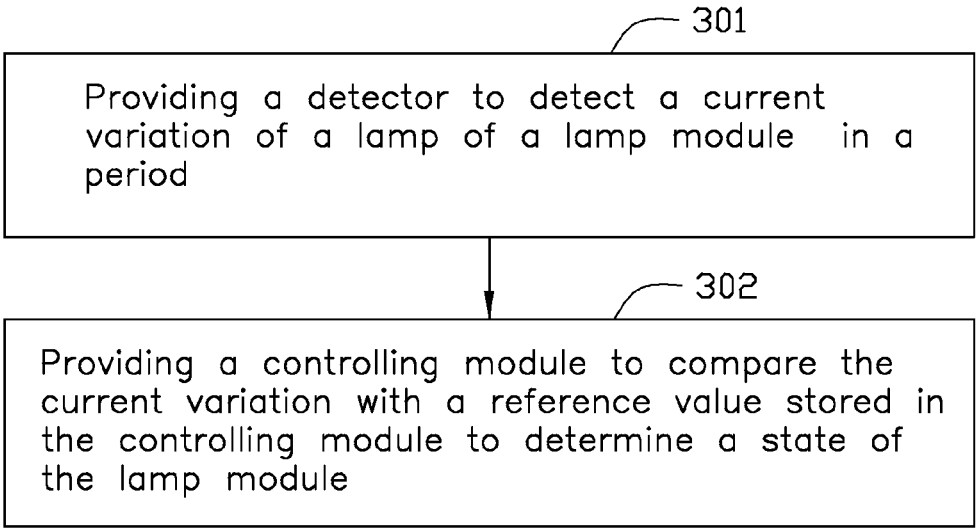
FIG. 8 is a flowchart diagram of a fault detection method for the fault detection apparatus of FIG. 1.

Referring to FIG. 8, a flowchart is presented in accordance with an example embodiment which is being thus illustrated. The example method 300 is provided by way of example, as there are a variety of ways to carry out the method. The method 300 described below can be carried out using the configurations illustrated in FIGS. 1 and 2, for example, and various elements of these figures are referenced in explaining example method 300. Each block shown in FIG. 3 represents one or more processes, methods or subroutines, carried out in the exemplary method 300. Additionally, the illustrated order of blocks is by example only and the order of the blocks can change according to the present disclosure. The exemplary method 300 can begin at block 301.

At block 301, provide a current detector 101 to detect a current variation of one lamp 202 of the lamp module 200 in a period.

At block 302, provide a controlling module 102 to compare the current variation with a reference value stored in the controlling module 102 to determine the fault state of the lamp module 200.

In at least one embodiment, the current detector can detect a previous current and a present current. The current variation can be calculated by the controlling module based on the previous current and the present current.

The embodiments shown and described above are only examples. Many details are often found in the art such as the other features of a fault detection apparatus and a fault detection method thereof. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to.

What is claimed is:

1. A fault detection apparatus coupled to a lamp module comprising a plurality of lamps, the fault detection apparatus comprising:

a current detector coupled with one of the plurality of lamps, wherein the current detector detects a previous current and a present current of the lamp; and a controlling module coupled to the current detector, the controlling module configured to calculate a current variation of the lamp based on the previous current and the present current, and a state of the lamp module based on the current variation.

2. The fault detection apparatus of claim 1, wherein the lamp module further comprises a driver, the driver supplies power to the lamps, and the lamps connect the driver and the current detector.

3. The fault detection apparatus of claim 1, wherein the state is a normal state, an open-circuit state, or a short-circuit state.

4. The fault detection apparatus of claim 1, wherein the lamps are arranged in parallel connection.

5. The fault detection apparatus of claim 1, wherein the current detector is a Hall current transformer.

6. The fault detection apparatus of claim 1, wherein the controlling module is a micro-control unit having a central processing unit (CPU) in combination with software.

7. The fault detection apparatus of claim further comprising an indicating module coupled to the controlling module, wherein the indicating module is configured for telling users about the state of the lamp module.

8. The fault detection apparatus of claim 7, wherein the indicating module comprises a display for displaying the state of the lamp module based on the calculated state.

9. The fault detection apparatus of claim 7, wherein the indicating module comprises an alarm device to warn users when the state of the lamp module is detected.

10. The fault detection apparatus of claim 7, wherein the indicating module is a communication module transmitting a signal of the lamp state to a remote monitor.

11. The fault detection apparatus of claim 1, wherein each lamp has a plurality of light sources, the light sources of each lamp are arranged in a series connection, and the number of the light sources of each lamp is at least 2.

12. The fault detection apparatus of claim 1, wherein the number of the lamps is at least 2.

13. A fault detection method of a fault detection apparatus, comprising:

providing a lamp module, the lamp module comprising at least one lamp;

providing a current detector to detect within a period, a previous current and a present current of one lamp of the lamp module; and providing a controlling module to calculate a current variation of the lamp based on the previous current and the present current, and compare the current variation with a reference value stored in the controlling module to determine a state of the lamp module.

* * * * *